US008028635B2

(12) United States Patent
Kanegawa et al.

(10) Patent No.: US 8,028,635 B2
(45) Date of Patent: Oct. 4, 2011

(54) FEED-OFF-ARM TYPE SEWING MACHINE FOR FLAT SEAMING

(75) Inventors: Yasuo Kanegawa, Toyonaka (JP); Toshiro Mitsuji, Toyonaka (JP)

(73) Assignee: Yamato Mishin Seizo Kabushiki Kaisha, Osaka (JP)

( * ) Notice: Subject to any disclaimer, the term of this patent is extended or adjusted under 35 U.S.C. 154(b) by 363 days.

(21) Appl. No.: 12/418,282

(22) Filed: Apr. 3, 2009

(65) Prior Publication Data

US 2009/0255453 A1 Oct. 15, 2009

(30) Foreign Application Priority Data

Apr. 10, 2008 (JP) ..... 2008-102791

(51) Int. Cl.
*D05B 75/00* (2006.01)

(52) U.S. Cl. ..... 112/259; 112/256

(58) Field of Classification Search ..... 112/256, 112/257, 235, 261, 245, 259, 470.15
See application file for complete search history.

(56) References Cited

U.S. PATENT DOCUMENTS

| | | | | |
|---|---|---|---|---|
| 2,729,176 A | | 1/1956 | Smith | |
| 2,837,173 A | * | 6/1958 | Ciecior | 184/6.15 |
| 2,914,009 A | | 11/1959 | Smith | |
| 3,486,474 A | * | 12/1969 | Hale et al. | 112/256 |
| 5,099,774 A | | 3/1992 | Gaudlitz | |
| 6,073,567 A | * | 6/2000 | Aoki | 112/237 |

FOREIGN PATENT DOCUMENTS

| | | |
|---|---|---|
| JP | 30-5835 | 1/1951 |
| JP | 53-109234 A | 9/1978 |
| JP | 55-25833 U | 2/1980 |
| JP | 7-57272 B2 | 6/1995 |
| JP | 2003-24673 A | 1/2003 |
| JP | 2003-126581 A | 5/2003 |
| JP | 2004-313740 A | 11/2004 |
| JP | 2005-27647 A | 2/2005 |
| JP | 2006-207697 A | 8/2006 |

* cited by examiner

*Primary Examiner* — Tejash Patel
(74) *Attorney, Agent, or Firm* — Birch, Stewart, Kolasch & Birch, LLP

(57) ABSTRACT

A needle bar supported in a head unit is connected with a needle bar lever extending from the inside of a sewing machine arm and the needle bar is moved up and down by swing of the needle bar lever about a supporting shaft generated by transmission from a sewing machine main shaft. The sewing machine arm and the head unit are fluid-tightly shielded by a shield plate, and a first sealing part is provided in the shield plate. The first sealing part supports the needle bar lever by fitting a portion of the needle bar lever into seal plates held between a presser plate and a back face of a seal support having a curved shape of a circular arc taken along a swinging locus of the needle bar lever. The inside of the sewing machine arm is oil-lubricated, and the inside of the head unit is grease-lubricated.

7 Claims, 6 Drawing Sheets

FEED-OFF-ARM TYPE SEWING MACHINE FOR FLAT SEAMING

CROSS-REFERENCE TO RELATED APPLICATIONS

This nonprovisional application claims priority under 35 U.S.C. §119(a) on Patent Application No. 2008-102791 filed in Japan on Apr. 10, 2008, the entire contents of which are hereby incorporated by reference.

BACKGROUND

1. Technical Field

The present invention relates to a feed-off-arm type sewing machine for flat seaming provided with various kinds of drive mechanisms including a needle bar drive mechanism, in a head unit arranged adjacent to an end portion of a sewing machine arm which incorporates a sewing machine main shaft.

2. Description of Related Art

For example, a feed-off-arm type sewing machine for flat seaming used for seaming of crotch portions of briefs and shorts, is provided with a sewing machine arm and a sewing machine bed extending in directions which are different from each other in an upper part and a lower part of a sewing machine frame, respectively (see, for example, Japanese Patent Application Laid-Open No. 7-57272 (1995)). A head unit is arranged adjacent to an end portion of the sewing machine arm in a direction substantially orthogonal to said sewing machine arm. A plurality of needles are mounted on a lower end of a needle bar which hangs from said head unit towards a tip of the sewing machine bed, and a presser metal is mounted on a lower end of a presser bar which is in proximity to the needle bar and hangs from the head unit.

Seaming by such a feed-off-arm type sewing machine for flat seaming is performed by the procedure of superimposing edges of two sheets of cloth to be seamed one on the other over a predetermined width, holding the edges between the presser metal mounted on the lower end of the presser bar and the sewing machine bed, feeding the cloth from a proximal side of the sewing machine bed towards a tip side thereof by an operation of a feeding mechanism located inside the sewing machine bed, and seaming the edges together by a coordinated operation of a plurality of needles which move up and down with the needle bar, and a looper located inside the sewing machine bed.

The needle bar is connected with a tip of a needle bar lever extending in the head unit from the inside of the sewing machine arm. The needle bar lever is a swinging lever which swings about a horizontal axis by transmission from a sewing machine main shaft incorporated in the sewing machine arm. The needle bar is constructed such that the needle bar moves up and down according to swing of the needle bar lever.

A transmitting mechanism for a top cover thread hook arranged above the presser metal, a knife provided in a part of the presser metal, or the like is arranged within the head unit. The transmitting mechanism is provided with a rotating member which penetrates a lower wall of the head unit inside and outside, and rotates about a vertical axis. A tip of an actuating rod extending in the head unit from the inside of the sewing machine arm is coupled with the rotating member. The rotating member is repeatedly rotated by reciprocation in an axial direction of the actuating rod by transmission from the sewing machine main shaft. This repetitive rotation is transmitted to said top cover thread hook or said knife, thereby causing the top cover thread hook or the knife to perform a predetermined operation.

SUMMARY

As mentioned above, in the feed-off-arm type sewing machine for flat seaming as well as many industrial sewing machines, increase in an operating speed is desired for improving efficiency of sewing work. In order to realize the speed-up, it is desirable to oil-lubricate respective parts of the sewing machine. However, when the inside of the head unit provided with the above mentioned needle bar and rotating member is oil-lubricated, there is a problem that oil for lubrication which circulates in the head unit could leak outside with vertical movement of the needle bar or rotation of the rotating member, and fall on cloth in sewing, thereby soiling said cloth.

This problem can be solved by grease-lubricating the mechanism inside the head unit. However since the head unit of the feed-off-arm type sewing machine for flat seaming secures an operation region of said needle bar arm and the actuating rod, and is communicated with the inside of the sewing machine arm, the inside of the sewing machine arm also must be grease-lubricated in order to prevent a defect caused by mixture of grease and oil. Thus, a rotational speed of the sewing machine main shaft which controls the operating speed is restricted, and dealing with a demand for the speed-up becomes difficult.

In view of this situation, the object of the present invention is providing a feed-off-arm type sewing machine for flat seaming which can meet the demand for the increase in the operating speed while preventing soiling of cloth caused by leaking out of lubrication oil.

A feed-off-arm type sewing machine for flat seaming according to a first aspect of the present invention is a feed-off-arm type sewing machine for flat seaming, comprising: a needle bar which is supported so as to move up and down, in a head unit arranged adjacent to an end portion of a sewing machine arm which incorporates a sewing machine main shaft; a rotating member which is supported so as to rotate about a vertical axis; a swinging lever which is supported inside said sewing machine arm, and extends in said head unit, a tip portion of which being connected with said needle bar; an actuating rod which extends from said sewing machine arm into said head unit, a tip portion of which being connected with said rotating member; and a shielding member which has a first sealing part for sealing a portion of said swinging lever and a second sealing part for sealing a portion of said actuating rod and thus shields fluid-tightly said sewing machine arm and said head unit from each other, wherein said needle bar is moved up and down by swing of said swinging lever caused by transmission from said sewing machine main shaft, said rotating member is rotated by movement of said actuating rod in an axial direction thereof caused by transmission from said sewing machine main shaft, and the inside of said sewing machine arm is oil-lubricated, and the inside of said head unit is grease-lubricated.

In the present invention, the shielding member fluid-tightly shields the sewing machine arm and the head unit from each other. Moreover, the portion of the swinging lever which extends in the head unit to drive the needle bar is sealed by the first sealing part provided in the shielding member without obstructing swing and the portion of the actuating rod which extends in the head unit to drive the rotating member is sealed by the second sealing part provided in the shielding member without obstructing its movement in an axial direction thereof. Hence, oil lubrication within the sewing machine arm and grease lubrication within the head unit are realized without generating a mixture of grease and oil.

A feed-off-arm type sewing machine for flat seaming according to a second aspect of the present invention is characterized in that said first sealing part in the first aspect includes a first receiving seat which has a curved shape of a circular arc taken along a swinging locus of said swinging lever and is provided in a peripheral portion of a first window hole provided in said shielding member to be penetrated by said swinging lever, a first presser plate which has a curved shape corresponding to said first receiving seat, and a first seal plate which is made of an elastic material, is fitted onto the portion of said swinging lever and held at the portion, and said first seal plate is held between said first receiving seat and said first presser plate so as to be slidable therebetween.

In this invention, the first sealing part is constructed to hold the seal plate which is fitted onto the portion of the swinging lever and held at the portion, between the receiving seat which is curved along a swinging locus of the swinging lever and the presser plate. Slide of the seal plate which is guided by the receiving seat and the presser plate enables swing of the swinging lever. Moreover, a mating part of the sewing machine arm and the head unit is sealed by a part in which the swinging lever is fitted and a part in which the receiving seat and the presser plate closely contact the seal plate.

A feed-off-arm type sewing machine for flat seaming according to a third of the present invention is characterized in that said second sealing part in the first aspect or the second aspect includes a peripheral portion of a second window hole provided in said shielding member to be penetrated by said actuating rod, a second seal plate which is made of an elastic material, and is fitted onto the portion of said actuating rod and held at the portion, and a second presser plate which holds with pressure and fixes a peripheral portion of said second seal plate between itself and the peripheral portion of said second window hole.

In this invention, the second sealing part is constructed to hold and fix the seal plate into which the actuating rod is inserted between the peripheral portion of the second window hole and the presser plate. Moreover, movement of the actuating rod is permitted without spoiling sealing properties by slide of the actuating rod in the insertion hole of the seal plate.

A feed-off-arm type sewing machine for flat seaming according to a fourth of the present invention is characterized in that a plurality of said second seal plates in the third aspect are superimposed between the peripheral portion of said second window hole and said second presser plate, and the respective second seal plates include insertion holes for said actuating rod, having cuts located at positions in circumferences of the insertion holes which are different from each other in a superimposed state.

In this invention, the cuts are provided in a part of the insertion hole of the seal plate and insertion of the actuating rod at the time of assembly is permitted by expansion of the cuts. On the other hand, a plurality of the seal plates are superimposed while the positions of the cuts are varied, thereby an overlap of cuts on an outer peripheries of the actuating rod is eliminated, and sealing properties are secured.

In the feed-off-arm type sewing machine for flat seaming according to the present invention, the sewing machine arm and the head unit are isolated by the shield plate, and the portions of the swinging arm and the actuating rod are sealed by the first and second sealing parts provided in the shield plate. Hence, a mating part of the sewing machine arm and the head unit can be fluid-tightly sealed while permitting swing of the swinging arm and movement of the actuating rod. Moreover, oil lubrication in the sewing machine arm and grease lubrication in the head unit can be realized without mixing oil and grease. Furthermore, the possibility the cloth is soiled by oil for lubrication is eliminated, and it is possible to meet the demand for the increased operating speed. Therefore the present invention achieves the above mentioned outstanding effects, for example.

The above and further objects and features will more fully be apparent from the following detailed description with accompanying drawings.

DETAILED DESCRIPTION

Figure 1:
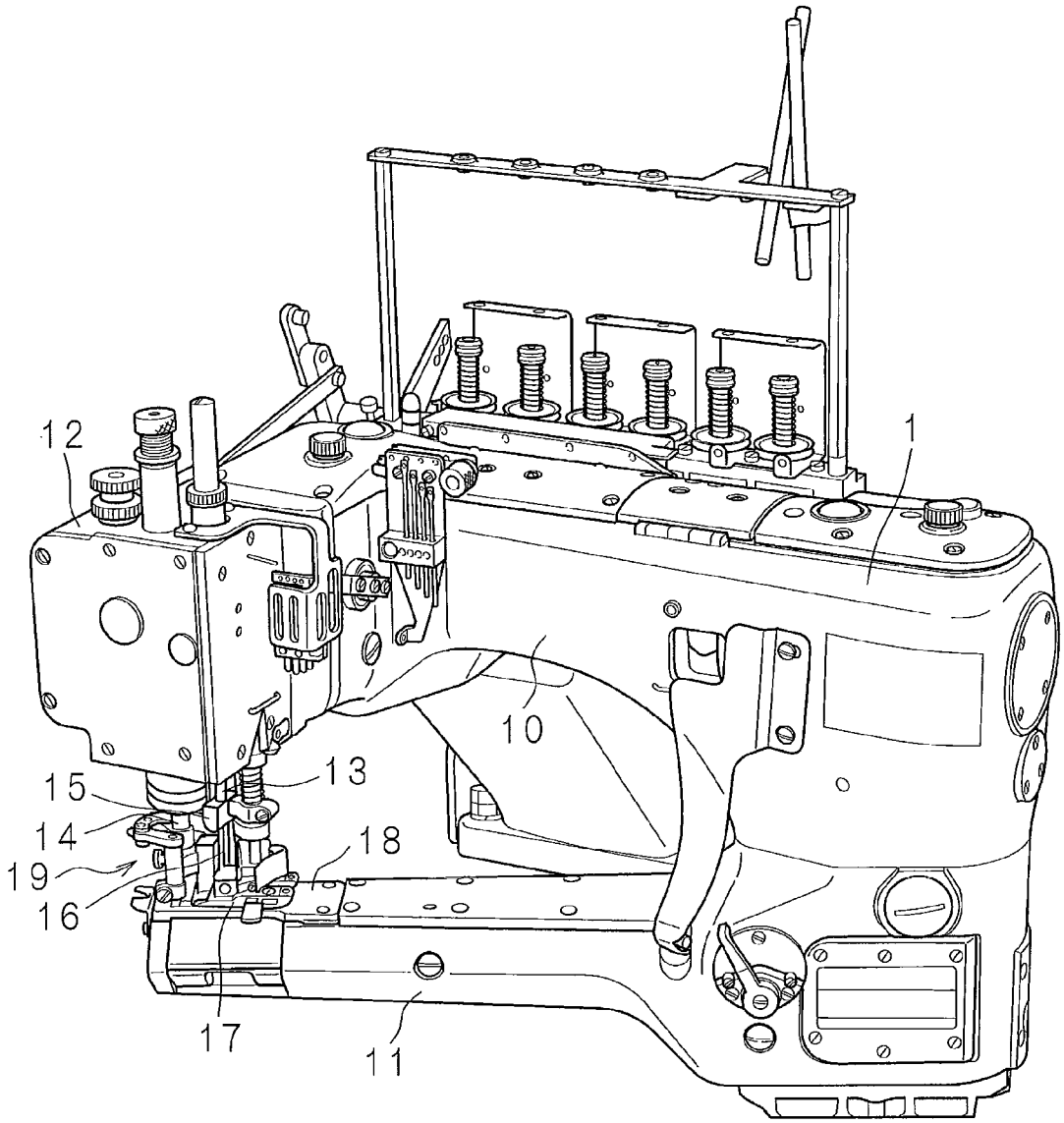
FIG. 1 is an external perspective view of a feed-off-arm type sewing machine for flat seaming according to the present invention.

The present invention is explained below in further detail with reference to drawings showing the embodiment thereof. FIG. 1 is an external perspective view of a feed-off-arm type sewing machine for flat seaming according to the present invention.

As shown in FIG. 1, the feed-off-arm type sewing machine for flat seaming comprises a sewing machine arm 10 extending in one direction in an upper part of a sewing machine frame 1, and a narrow width cylinder type sewing machine bed 11 extending in a direction which is different from that of the sewing machine arm 10 in a lower part of the sewing machine frame 1. A head unit 12 in the shape of a hollow rectangular block is arranged adjacent to an end portion of the sewing machine arm 10 in a direction substantially orthogonal to the sewing machine arm 10.

Under the head unit 12, a needle bar 13 and a presser bar 14 are supported to hang towards a tip portion of the sewing machine bed 11 which is opposed to the head unit 12. A plurality of needles 16, 16 . . . are mounted on a lower end of the needle bar 13 via a needle clamp 15. A presser metal 17 is mounted on a lower end of the presser bar 14.

The needle bar 13 and presser bar 14 are supported inside the head unit 12 so as to move up and down. The needle bar 13 moves up and down with the needles 16, 16 . . . mounted on the lower end thereof, by an operation of a needle bar drive mechanism (see, FIG. 2 and FIG. 3) provided over the insides of the sewing machine arm 10 and the head unit 12. The presser metal 17 comes into a resilient contact with a needle plate 18 provided over the tip portion of the sewing machine bed 11 by downward movement of the presser bar 14, and cloth which is not illustrated is held between the presser metal 17 and the needle plates 18. The cloth held between the presser metal 17 and the needle plate 18 is fed from a base of the sewing machine bed 11 towards a tip side thereof, by an operation of a feeding mechanism, which is not illustrated, provided within the sewing machine bed 11. The cloth is seamed by a coordinated operation with said needle 16, 16 . . . which move up and down synchronizing with this feed, and a looper, which is not illustrated, provided within the sewing machine bed 11.

A top cover thread hook mechanism 19 is provided above the presser metal 17. The top cover thread hook mechanism 19 performs a known operation for arranging top cover thread on an upper surface of cloth in sewing on the needle plate 18 by an operation of a hook drive mechanism (see, FIG. 2 and FIG. 4) provided over the insides of the sewing machine arm 10 and the head unit 12.

Figure 2:
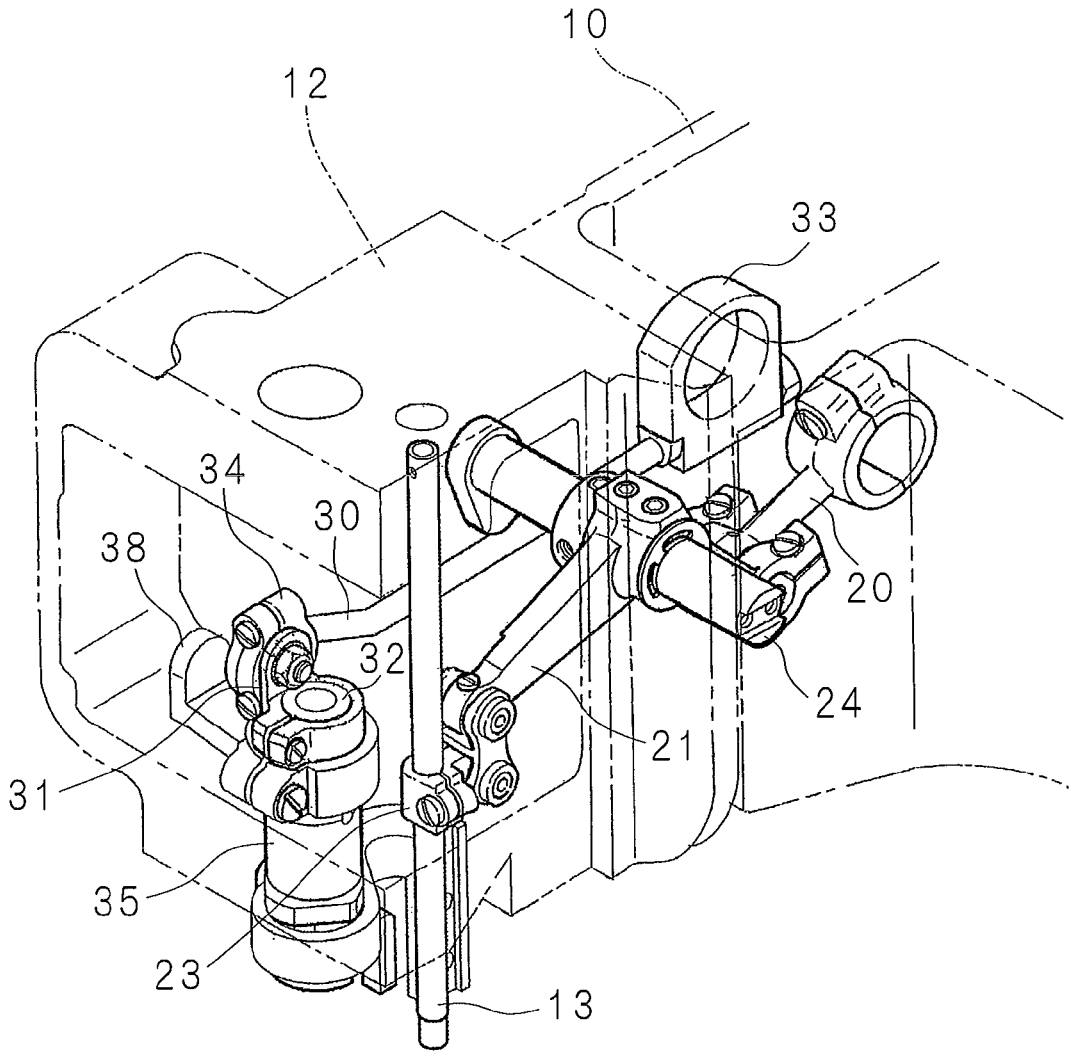
FIG. 2 is a perspective view of a needle bar drive mechanism and a hook drive mechanism.
Figure 3:
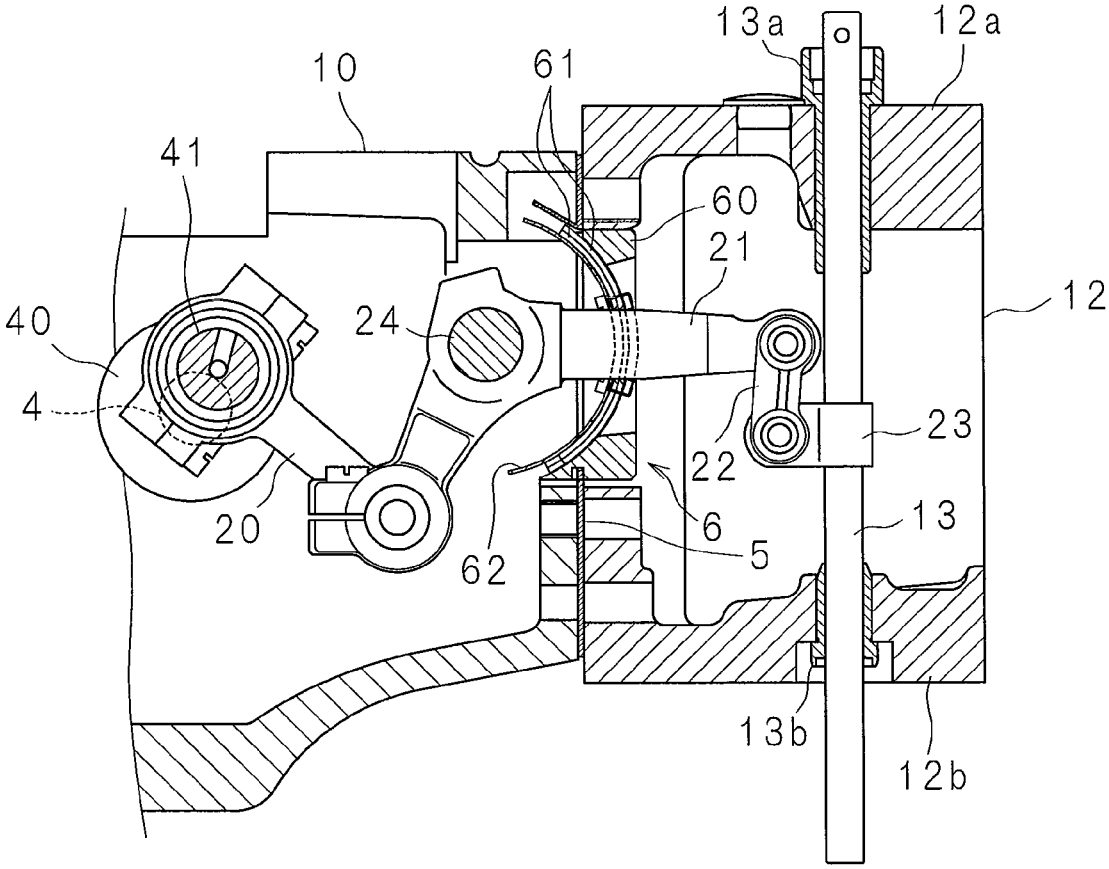
FIG. 3 is a longitudinal sectional view of a sewing machine arm and a head unit showing a part composing the needle bar drive mechanism.
Figure 4:
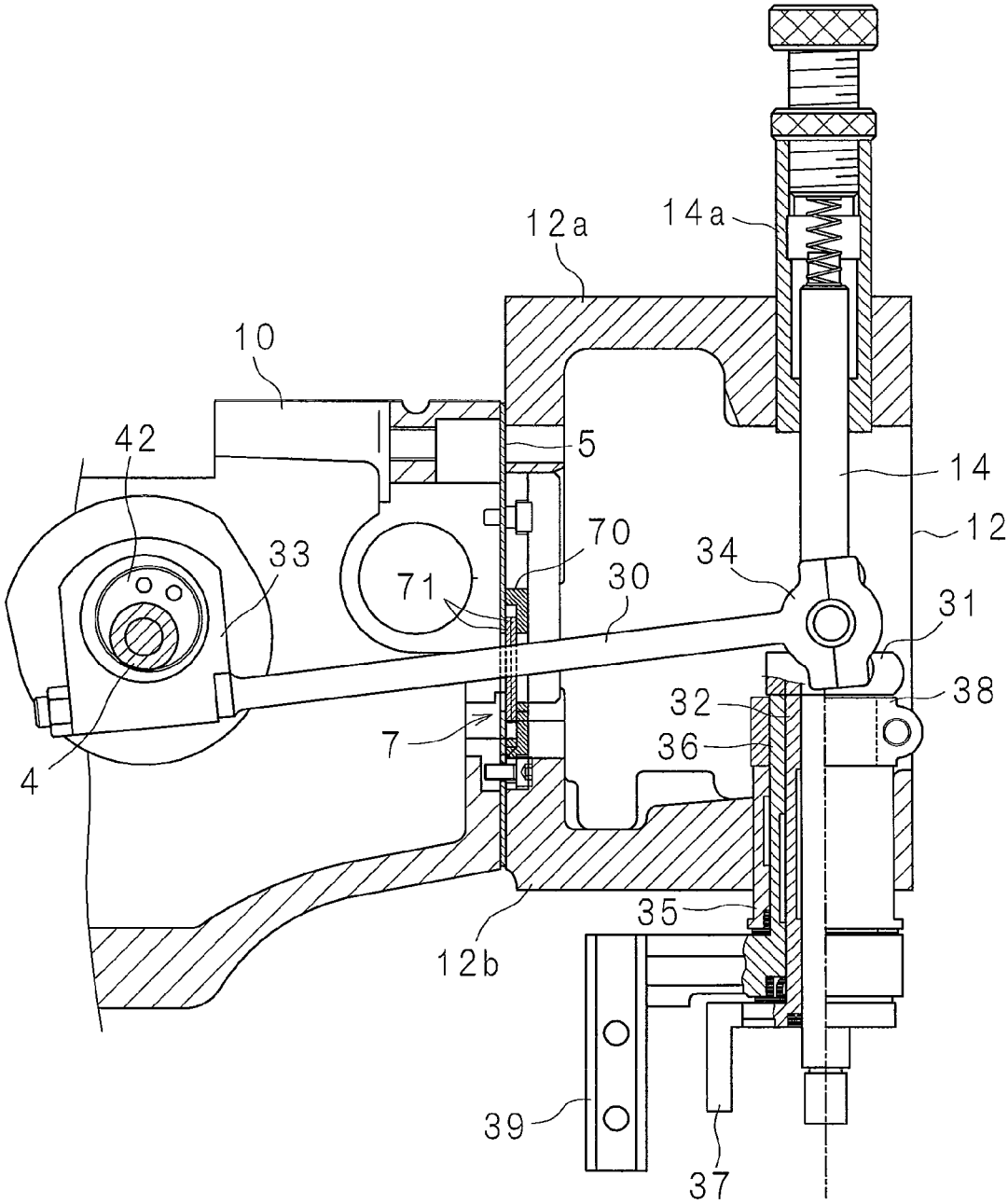
FIG. 4 is a longitudinal sectional view of the sewing machine arm and the head unit showing a part composing the hook drive mechanism.

FIG. 2 is a perspective view of the needle bar drive mechanism and the hook drive mechanism, and the sewing machine arm 10 and the head unit 12 are shown with a two-dot chain line in FIG. 2. FIG. 3 is a longitudinal sectional view of the sewing machine arm 10 and the head unit 12 showing a part composing the needle bar drive mechanism, and FIG. 4 is a longitudinal sectional view of the sewing machine arm 10 and the head unit 12 showing a part composing the hook drive mechanism.

First, a constitution of the needle bar drive mechanism is explained with reference to FIG. 2 and FIG. 3. The needle bar drive mechanism transmits rotation of a sewing machine main shaft 4 incorporated in the sewing machine arm 10 to the needle bar 13 provided in the head unit 12, moves said needle bar 13 up and down, and is provided with a needle bar arm 20, a needle bar lever 21 (swinging lever), a needle bar link 22, and needle bar connecting bracket 23.

A crank disk 40 is fixed to the sewing machine main shaft 4 shown with a dashed line in FIG. 3, and a diameter of the crank disk 40 is larger than that of the sewing machine main shaft 4. A crank pin 41 projects on one surface of the crank disk 40, while the crank pin 41 is decentered with respect to the sewing machine main shaft 4. One end portion of the needle bar arm 20 is supported pivotally by the crank pin 41.

Within the sewing machine arm 10, a supporting shaft 24 is provided traversely facing a part arranged adjacent to the head unit 12, in parallel to the sewing machine main shaft 4. The supporting shaft 24 pivotally supports a middle portion of the needle bar lever 21 so as to swing. As shown in FIG. 3, the needle bar lever 21 is an approximately L-shaped lever bent at a portion pivotally supported by the supporting shaft 24. One end portion (proximal end portion) of the needle bar lever 21 extending in the sewing machine arm 10 is connected with the other end portion of the needle bar arm 20.

The other end portion (tip portion) of the needle bar lever 21 substantially horizontally extends in the head unit 12, and reaches the vicinity of the needle bar 13 supported in the head unit 12. As shown in FIG. 3, the needle bar 13 is fitted into needle bar bushings 13*a*, 13*b* provided so as to penetrate an upper wall and a lower wall of the head unit 12 on the same axis, and the needle bar 13 is supported by the needle bar bushes 13*a*, 13*b* so as to move up and down. The needle bar connecting bracket 23 is located between the upper needle bar bushing 13*a* and the lower needle bar bushing 13*b*, and fixed on the needle bar 13. The needle bar connecting bracket 23 is connected with a tip portion of the needle bar lever 21 extending in the head unit 12 via the needle bar link 22.

In the needle bar drive mechanism constructed like the above, when the sewing machine main shaft 4 rotates, the crank pin 41 provided in one surface of the crank disk 40 rotates along the circumference of a circle with a radius equal to an eccentric length from the sewing machine main shaft 4. When the proximal end portion of the needle bar lever 21 connected with the crank pin 41 via the needle bar arm 20 is pushed and pulled by this rotation, said needle bar lever 21 swings about the supporting shaft 24 as a pivot. By this swing, the tip portion of the needle bar lever 21 extending in the head unit 12 moves up and down, this movement is transmitted to the needle bar 13 via the needle bar link 22 and the needle bar connecting bracket 23, and said needle bar 13 moves up and down.

Next, a constitution of the hook drive mechanism is explained with reference to FIG. 2 and FIG. 4. The hook drive mechanism transmits rotation of the sewing machine main shaft 4 incorporated in the sewing machine arm 10 to the top cover thread hook mechanism 19 provided above the presser metal 17 as described above, via the inside of the head unit 12, and causes the top cover thread hook mechanism 19 to perform the above mentioned operation. The hook drive mechanism is provided with a hook rod 30 (actuating rod), a hook lever 31, and a hook driving cylinder 32 (rotating member).

The hook rod 30 is a long rod extending over the inside of the head unit 12 from the inside of the sewing machine arm 10, as shown in FIG. 4. A proximal end portion of the hook rod 30 extending toward the sewing machine arm 10 side is connected with a ring holder 33 provided with a circular holding hole. As shown in FIG. 4, the ring holder 33 holds an eccentric ring 42 which is fitted therein, the eccentric ring 42 being fixed to a corresponding portion of the sewing machine main shaft 4.

A tip portion of the hook rod 30 extending in the head unit 12 side is connected with the hook driving cylinder 32 arranged in the head unit 12 via a ball joint 34 and the hook lever 31, as shown in FIG. 2. As shown in FIG. 4, the hook driving cylinder 32 is fitted in a support cylinder 35 fixed so as to penetrate the lower wall 12*b* of the head unit 12 upward and downward via a knife driving cylinder 36, and is supported so as to rotate on the same axis. An upper end of the knife driving cylinder 36 is projected by suitable length from an upper part of the support cylinder 35. An upper end of the hook driving cylinder 32 is further projected by suitable length from an upper part of the knife driving cylinder 36, and the hook lever 31 is fixed on this projecting end.

A lower end of the hook driving cylinder 32 is projected by suitable length from a bottom of the knife driving cylinder 36, and is located outside the head unit 12. A hook bracket 37 is provided in this projecting end, and is connected with the above mentioned top cover thread hook mechanism 19.

In the hook drive mechanism constructed like the above, when the sewing machine main shaft 4 rotates, the ring holder 33 for holding the eccentric ring 42 which rotates with the machine main shaft 4 moves up and down, and right and left, and the hook rod 30 advances and withdraws in an axial direction thereof accompanying the upward and downward movement. This back and forth movement is transmitted to the hook lever 31 coupled with a tip of the hook rod 30. As a result of an operation in which a coupling end of said hook lever 31 is pushed and pulled, the hook driving cylinder 32 repeatedly rotates about an axis thereof. This repetitive rotation is transmitted to the top cover thread hook mechanism 19 via the hook bracket 37 located in a lower end, thereby enabling said top cover thread hook mechanism 19 to perform the above mentioned operation.

Note that a knife lever 38 similar to the hook lever 31 is fixed on the projecting end of the knife driving cylinder 36 above the upper part of the support cylinder 35. The knife lever 38 is connected with the sewing machine main shaft 4 located in the sewing machine arm 10 via the actuating rod which is not illustrated, and the knife driving cylinder 36 is constructed to repeatedly rotate about a shaft thereof according to rotation of the sewing machine main shaft 4. The repetitive rotation of the knife driving cylinder 36 is transmitted to a knife mechanism (not shown) provided in the presser metal 17 via a knife bracket 39 located in a lower end, and drives said knife mechanism.

As shown in FIG. 4, a lower part of the pressure bar 14 runs through the hook driving cylinder 32. An upper part of the presser bar 14 runs through an upper bushing 14*a* fastened to the head unit 12 so as to penetrate the upper wall 12*a* of the head unit 12 upward and downward. Thus, the hook driving cylinder 32 also serves as a support bushing for both end support, by supporting two places of the presser bar 14 which are isolated up and down together with the upper bushing 14*a*. The presser bar 14 can move up and down under the guidance of the hook driving cylinder 32 and the upper bushing 14*a*. With the upward and downward movement, the presser metal 17 mounted on the lower end of the presser bar 14 goes up and down.

In the feed-off-arm type sewing machine for flat seaming according to the present invention as mentioned above, the needle bar 13 supported so as to move up and down in the head unit 12 is connected with the tip portion of the needle bar lever 21 which is supported in the sewing machine arm 10 and extends in the head unit 12, and swing of the needle bar lever 21 which is pivoted on the supporting shaft 24 is transmitted, thereby moving the needle bar 13 up and down. Moreover, the hook driving cylinder 32 provided in the head unit 12 is connected with the tip portion of the hook rod 30 extending in the head unit 12 from the sewing machine arm 10, and the hook rod 30 is moved in the axial direction thereof by transmission from the sewing machine main shaft 4, thereby repeatedly rotating the hook driving cylinder 32 about a vertical axis.

As shown in FIG. 3 and FIG. 4, the sewing machine arm 10 and the head unit 12 are isolated with a shield plate 5 (shielding member) held between mating surfaces thereof. The shield plate 5 is a thin plate made of metal or resin having sufficient rigidity, and is held between the mating surfaces of the sewing machine arm 10 and the head unit 12 via a sealing member. The shield plate 5 is provided with a first sealing part 6 which seals a middle portion (a portion) of the needle bar lever 21 extending in the head unit 12 from the sewing machine arm 10, and a second sealing part 7 which seals a middle portion (a portion) of the hook rod 30.

Figure 5:
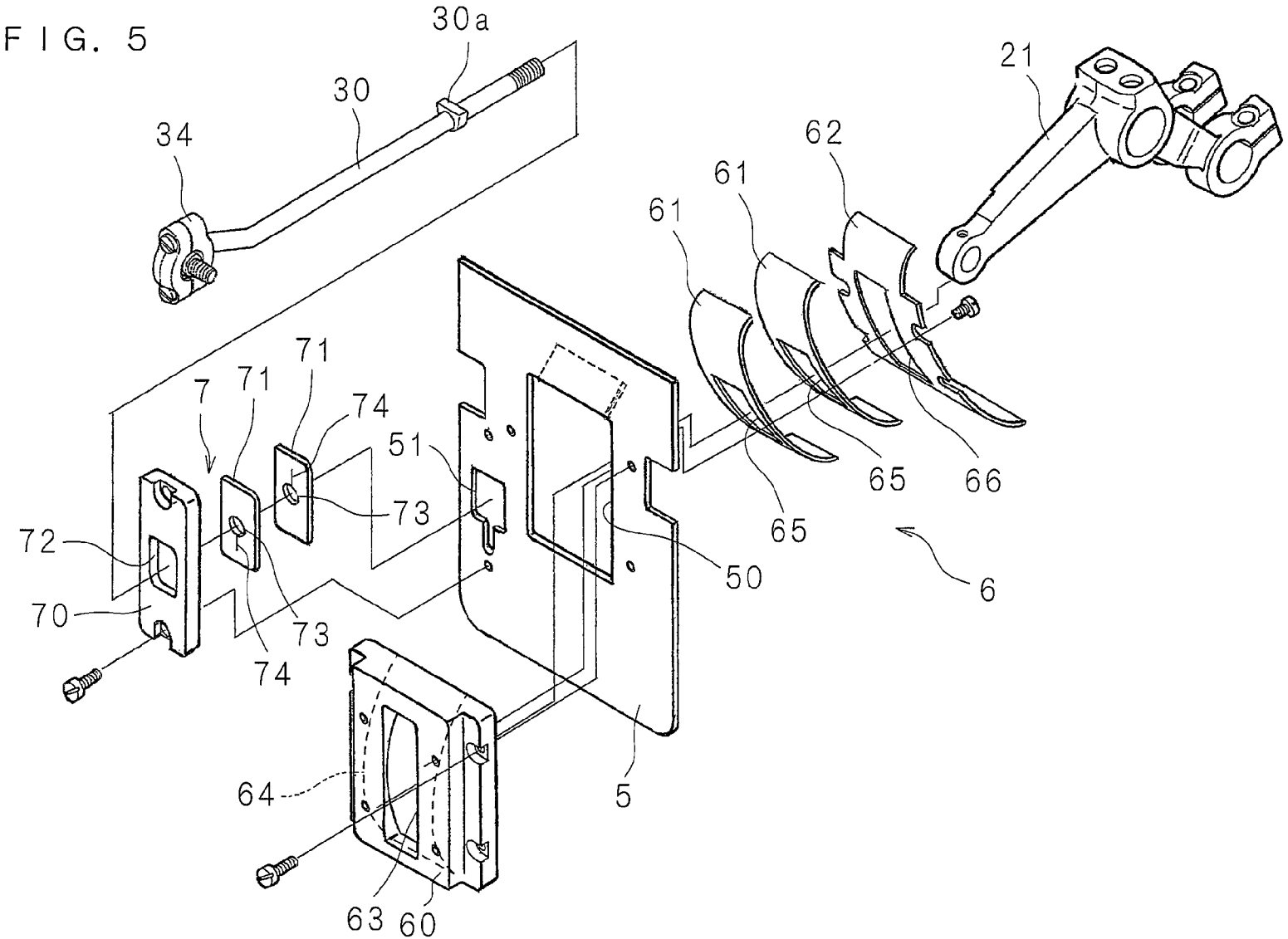
FIG. 5 is an exploded perspective view of a first sealing part and a second sealing part.

FIG. 5 is an exploded perspective view of the first sealing part 6 and the second sealing part 7. As shown in FIG. 5, the shield plate 5 is a rectangular plate corresponding to a mating part of the sewing machine arm 10 and the head unit 12, and is provided with a first window hole 50 perforated in order to provide the first sealing part 6, and a second window hole 51 perforated in order to provide the second sealing part 7.

The first sealing part 6 is provided with a seal support 60 screwed and fixed to a peripheral portion of the first window hole 50 of the shield plate 5, two seal plates 61, 61 (first seal plates), and a presser plate 62 (first presser plate) which holds the seal plates 61, 61 between itself and the seal support 60.

The seal support 60 is a rectangular thick plate having a width and a length capable of closing the first window hole 50. In a substantially central portion of the seal support 60, a rectangular window hole 63 which has a width permitting penetration of the needle bar lever 21, and an upward and downward length corresponding to a swinging range of the needle bar lever 21 is perforated. As shown by a dashed line in FIG. 5, a receiving seat 64 (first receiving seat) having a curved shape of a circular arc is formed in a back face of the seal support 60 so that a peripheral portion of the window hole 63 may be bordered.

The seal plates 61, 61 are plates made of an elastic material, such as rubber, resin etc., and in substantially central portions of the seal plates 61, 61, fitting holes 65, 65 which permit the middle portion of the needle bar lever 21 to tightly fit in are formed respectively. The presser plate 62 is a thin plate made of a rigid material, and has a curved shape corresponding to the receiving seat 64 of the seal support 60. In a substantially central portion of the presser plate 62, a window hole 66 having a shape which is substantially identical with the shape of the window hole 63 of the seal support 60 is perforated. The curved shapes of the receiving seat 64 and the presser plate 62 are determined so as to correspond to a swinging locus of the needle bar lever 21 which is pivoted on the supporting shaft 24.

The first sealing part 6 having the above constituent parts is constructed, as shown in FIG. 5, such that the seal plates 61, 61 are held between the presser plate 62 and the receiving seat 64, by screwing and fixing the seal support 60 on the shield plate 5 from the head unit 12 side (left-hand side of FIG. 5), superimposing the two seal plates 61, 61 while aligning the positions of the fitting hole 65, 65 with the receiving seat 64 located in the back face of the seal support 60 exposed from the first window hole 50, respectively, further superimposing the presser plate 62, and screwing and fixing the presser plate 62 on the seal support 60. As mentioned above, the first sealing part 6 is mounted by holding the shield plate 5 between the sewing machine arm 10 and the head unit 12, as shown in FIG. 3.

The needle bar lever 21 which is supported pivotally within the sewing machine arm 10 extends in the head unit 12 by inserting the tip portion thereof into the fitting holes 65, 65 of the seal plates 61, 61. The fitting holes 65, 65 provided in the seal plates 61, 61 can tightly fit on the middle portion of the needle bar lever 21, and can seal a fitting part. Since sealing properties of peripheral portions of the seal plates 61, 61 are maintained by being held between the presser plate 62 and the receiving seat 64, the first sealing part 6 can reliably seal the middle portion of the needle bar lever 21 in an assembled state shown in FIG. 3.

The needle bar lever 21 swings about the supporting shaft 24 as a pivot as mentioned above, and by this swing, the force of upward and downward movement is applied to the seal plates 61, 61 fitted in the middle portion of the needle bar lever 21, along the swinging locus. Here, since the seal plates 61, 61 are held between the receiving seat 64 and the presser plate 62, and the receiving seat 64 and the presser plate 62 have the curved shape corresponding to the swinging locus of the needle bar lever 21 as mentioned above, the seal plates 61, 61 can follow swing of the needle bar lever 21 with a slide with respect to the receiving seat 64 and the presser plate 62.

Figure 6A:
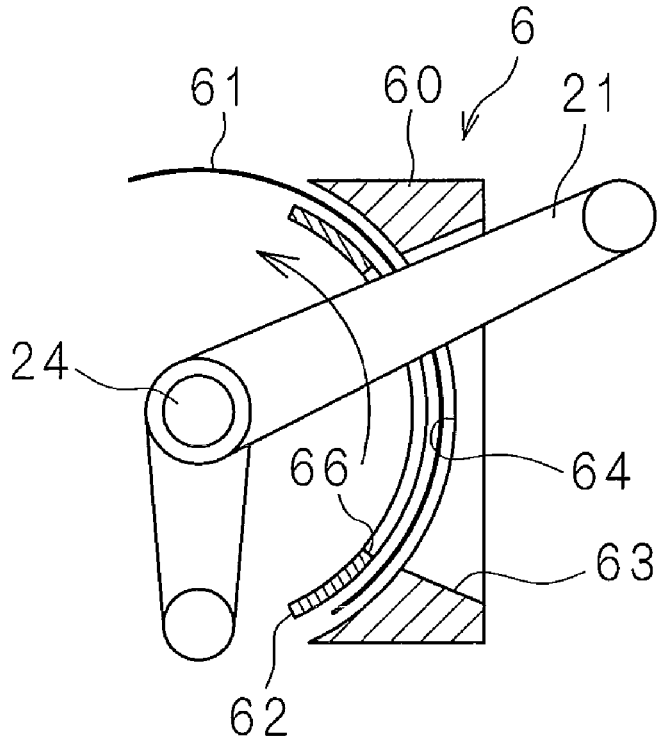
FIGS. 6A and 6B are explanatory views of an operation of the first sealing part.
Figure 6B:
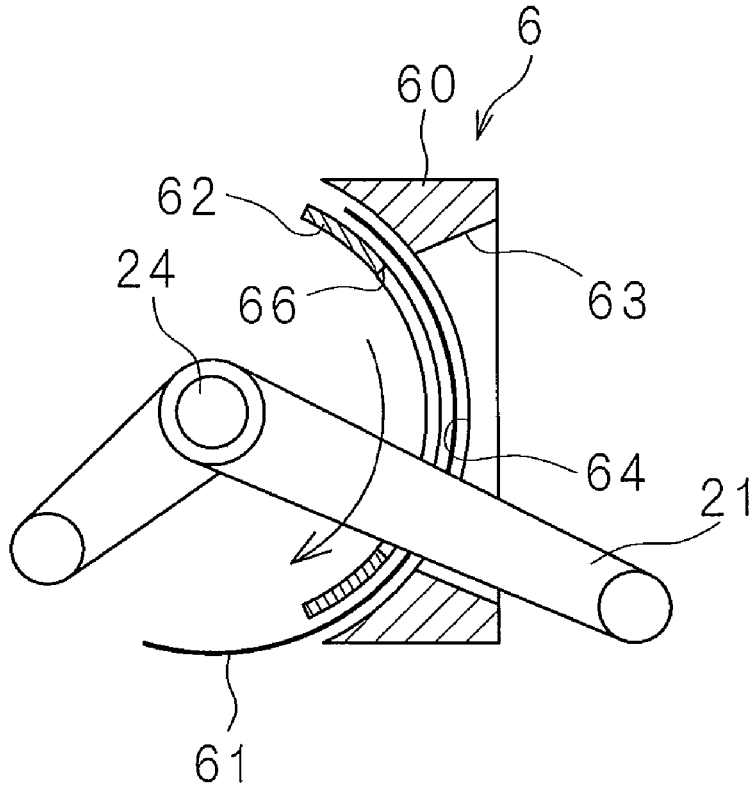

FIGS. 6A and 6B are explanatory views of an operation of the first sealing part 6. In FIG. 6A, the state in which the needle bar lever 21 is in an upward moving position is shown, and in FIG. 6B, the state in which the needle bar lever 21 is in a downward moving position is shown. By the swing of the needle bar lever 21, the seal plate 61 (only one plate is illustrated) moves between the receiving seat 64 and the presser plate 62 having the above mentioned curved shapes, as shown in FIGS. 6A and 6B.

A length of the seal plate 61 is set so that a held state of a lower part thereof may be maintained in the upward moving position as shown in FIG. 6A and a held state of an upper part thereof may be maintained in the downward moving position as shown in FIG. 6B. Sealing properties of peripheral portions of the seal plates 61 containing upper and lower edges thereof are sufficiently maintained in an entire movement range shown in FIGS. 6A and 6B. The sealing properties between the needle bar lever 21 and the seal plate 61 are also maintained, since the seal plate 61 moves to follow the needle bar lever 21.

As described above, the first sealing part 6 can reliably seal a periphery of the needle bar lever 21 extending in the head unit 12 from the sewing machine arm 10, without obstructing swing of said needle bar lever 21. Note that in the above embodiment, although the receiving seat 64 is provided in the seal support 60 which is a component separate from the shield plate 5, said receiving seat 64 and the shield plate 5 can be provided as one body by curvedly molding of a corresponding part of the shield plate 5.

The seal plates 61, 61 are mounted so that they may have both reliable sealing of the peripheral portions and smooth sliding thereof with the supporting strength adjusted between the presser plate 62 and the receiving seat 64 when the presser plate 62 is mounted. In order to improve sealing properties and sliding properties of the seal plates 61, 61, it is effective for example to coat the presser plate 62 and the receiving seat 64 with a resin material having a low friction coefficient such as a fluorocarbon resin etc.

On the other hand, the second sealing part 7 which seals the middle portion of the hook rod 30 is provided with a seal support 70 (second presser plate) screwed and fixed on a peripheral portion of the second window hole 51 of the shield plate 5, and two seal plates 71, 71 (second seal plates). The seal support 70 is a rectangular frame plate provided with a through hole 72 corresponding to the second window hole 51 in a substantially central portion thereof. The seal plates 71, 71 are rectangular plates made of an elastic material, such as rubber and resin etc., and in substantially central portions thereof, insertion holes 73, 73 which permit the middle portion of hook rod 30 to tightly fit in are formed respectively.

As shown in FIG. 5, the second sealing part 7 is constructed by superimposing the seal support 70 and the two seal plates 71, 71 so as to close the second window hole 51 from the head unit 12 side (left-hand side of FIG. 5), screwing and fixing a peripheral portion of the seal support 70 to the shield plate 5, and holding the two seal plates 71, 71 between the seal support 70 and the peripheral portion of the second window hole 51. The second sealing part 7 is mounted by holding the shield plate 5 between the sewing machine arm 10 and the head unit 12, as shown in FIG. 4.

As shown in FIG. 5, the hook rod 30 extends in the sewing machine arm 10 penetrating the insertion holes 73, 73 provided in the seal plates 71, 71 from the head unit 12 side. The hook rod 30 is connected with the sewing machine main shaft 4 via the ring holder 33, as shown in FIG. 4. The seal plates 71, 71 provide sealing by making inner peripheral portions of the insertion holes 73, 73 closely contact with the middle portion of the hook rod 30. The hook rod 30 reciprocates in an axial direction thereof according to rotation of the sewing machine main spindle 4, and at this time the middle portion of the hook rod 30 inserted into the insertion holes 73, 73 is displaced in a face perpendicular to a reciprocating direction thereof. However, since the seal plates 71, 71 made of an elastic material follow displacement of the hook rod 30, the close contact of the hook rod 30 and the insertion holes 73, 73 is maintained, thereby reliably sealing the middle portion of the hook rod 30.

As shown in FIG. 5, the seal plates 71, 71 provided with the insertion holes 73, 73 have cuts 74, 74 of an appropriate length each extending radially outward at one place of a circumference of the insertion holes 73. The seal plates 71, 71 are superimposed so that positions at which the cuts 74, 74 are formed may differ from each other in the circumferential direction and preferably the positions may be opposite to each other. As shown in FIG. 5, a stopper ring 30a used for positioning with respect to the ring holder 33 is provided in the proximal end side of the hook rod 30 inserted into the insertion holes 73, 73. When the hook rod 30 is inserted as mentioned above, said cuts 74, 74 are enlarged according to an operation of the stopper ring 30a, and act so that passage of said stopper ring 30a may be permitted.

Since the cuts 74, 74 are closed by resilient restoration after passage of the stopper ring 30*a*, the close contact of the insertion holes 73, 73 to an outer peripheral portion of the hook rod 30 is not obstructed. Since the cuts 74, 74 of the seal plates 71, 71 are provided at the different positions in the circumferential direction as mentioned above and they do not overlap on the outer peripheral portion of the hook rod 30, the entire outer peripheral portion of the hook rod 30 is favorably sealed. As mentioned above, the second sealing part 7 can reliably seal the middle portion of the hook rod 30 extending in the head unit 12 from the sewing machine arm 10, without obstructing reciprocation of said hook rod 30.

In the feed-off-arm type sewing machine for flat seaming according to the present invention, the sewing machine arm 10 and the head unit 12 are isolated by the shield plate 5 provided with the first sealing part 6 and second sealing part 7 constructed as mentioned above. As mentioned above, since the first sealing part 6 seals the middle portion of the needle bar lever 21 as the swinging lever over the entire swinging range of said needle bar lever 21, and the second sealing part 7 seals the middle portion of the hook rod 30 as the actuating rod without obstructing reciprocation of said hook rod 30, the inside of the sewing machine arm 10 and the inside of the head unit 12 can be isolated while they are maintained in a fluid-tight state, a lubrication structure in which the inside of the sewing machine arm 10 is oil-lubricated and the inside of the head unit 12 is grease-lubricated can be realized without mutual interference.

Oil lubrication within the sewing machine arm 10 can be realized by a general constitution which is known in the prior art. Grease lubrication within the head unit 12 can be realized by a constitution in which, for example, felt impregnated with grease is arranged in an inner face of the head unit 12, and grease is suitably supplied from the felt which is put in contact with upper and lower supporting parts of the needle bar 13, supporting parts of the hook driving cylinder 32 and the knife driving cylinder 36, or the like, respectively.

Since the inside of head unit 12 is grease-lubricated, even though grease for lubrication leaks outside with upward and downward movement of the needle bar 13 or repetitive rotation of the hook driving cylinder 32 and the knife driving cylinder 36, the possibility that the grease falls on cloth in sewing and said cloth is soiled can be reduced. Also, since the inside of the sewing machine arm 10 is oil-lubricated, high-speed operation becomes possible and improvement in sewing efficiency can be accomplished.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A feed-off-arm type sewing machine for flat seaming, comprising:

a needle bar which is supported so as to move up and down, in a head unit arranged adjacent to an end portion of a sewing machine arm which incorporates a sewing machine main shaft;

a rotating member which is supported so as to rotate about a vertical axis;

a swinging lever which is supported inside said sewing machine arm, and extends in said head unit, a tip portion of which being connected with said needle bar;

an actuating rod which extends from said sewing machine arm into said head unit, a tip portion of which being connected with said rotating member; and a shielding member which has a first sealing part for sealing a portion of said swinging lever and a second sealing part for sealing a portion of said actuating rod, and thus shields fluid-tightly said sewing machine arm and said head unit from each other, wherein said needle bar is moved up and down by swing of said swinging lever caused by transmission from said sewing machine main shaft, said rotating member is rotated by movement of said actuating rod in an axial direction thereof caused by transmission from said sewing machine main shaft, and the inside of said sewing machine arm is oil-lubricated, and the inside of said head unit is grease-lubricated.

2. The feed-off-arm type sewing machine for flat seaming according to claim 1, wherein said first sealing part includes a first receiving seat which has a curved shape of a circular arc taken along a swinging locus of said swinging lever and is provided in a peripheral portion of a first window hole provided in said shielding member to be penetrated by said swinging lever, a first presser plate which has a curved shape corresponding to said first receiving seat, and a first seal plate which is made of an elastic material, is fitted onto the portion of said swinging lever and held at the portion, and said first seal plate is held between said first receiving seat and said first presser plate so as to be slidable therebetween.

3. The feed-off-arm type sewing machine for flat seaming according to claim 2, wherein said first receiving seat and said first presser plate are coated with a resin material.

4. The feed-off-arm type sewing machine for flat seaming according to claim 2, wherein said first seal plate has a fitting hole permitting the portion of said swinging lever to fit in.

5. The feed-off-arm type sewing machine for flat seaming according to claim 2, wherein said first receiving seat and said first presser plate each includes a window hole having a width permitting penetration of said swinging lever and a length corresponding to a swinging range of said swinging lever.

6. The feed-off-arm type sewing machine for flat seaming according to claim 1, wherein said second sealing part includes a peripheral portion of a second window hole provided in said shielding member to be penetrated by said actuating rod, a second seal plate which is made of an elastic material, and is fitted onto the portion of said actuating rod and held at the portion, and a second presser plate which holds with pressure and fixes a peripheral portion of said second seal plate between itself and the peripheral portion of said second window hole.

7. The feed-off-arm type sewing machine for flat seaming according to claim 6, wherein a plurality of said second seal plates are superimposed between the peripheral portion of said second window hole and said second presser plate, and the respective second seal plates include insertion holes for said actuating rod, having cuts located at positions in circumferences of the insertion holes which are different from each other in a superimposed state.

* * * * *